US012668928B2

(12) United States Patent
Hofstaetter et al.

(10) Patent No.: US 12,668,928 B2
(45) Date of Patent: Jun. 30, 2026

(54) TRACK MAINTENANCE MACHINE FOR TAMPING A TRACK

(71) Applicant: Plasser & Theurer Export von Bahnbaumaschinen Gesellschaft m.b.H., Vienna (AT)

(72) Inventors: Josef Hofstaetter, Puchenau (AT); Heinz Springer, Tokyo (JP)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 812 days.

(21) Appl. No.: 18/019,350

(22) PCT Filed: Aug. 31, 2021

(86) PCT No.: PCT/EP2021/073946
§ 371 (c)(1),
(2) Date: Feb. 2, 2023

(87) PCT Pub. No.: WO2022/058154
PCT Pub. Date: Mar. 24, 2022

(65) Prior Publication Data

US 2023/0340734 A1 Oct. 26, 2023

(30) Foreign Application Priority Data

Sep. 16, 2020 (AT) ..... A 50786/2020

(51) Int. Cl.
*E01B 27/17* (2006.01)
*E01B 27/16* (2006.01)

(52) U.S. Cl.
CPC ..... *E01B 27/17* (2013.01); *E01B 27/16* (2013.01); *E01B 2203/015* (2013.01);
(Continued)

(58) Field of Classification Search
CPC ..... E01B 27/17; E01B 2203/015; E01B 2203/10; E01B 2203/122; E01B 2203/125; E01B 27/16; E01B 2203/12
See application file for complete search history.

(56) References Cited

U.S. PATENT DOCUMENTS 4,369,712 A * 1/1983 von Beckmann ..... E01B 27/16 104/12
4,905,604 A * 3/1990 Theurer ..... E01B 27/17 104/10
(Continued)

FOREIGN PATENT DOCUMENTS

CN 110685196 A 1/2020
CZ 355596 A3 * 7/1997 ..... E01B 27/17
(Continued)

OTHER PUBLICATIONS

International Search Report in PCT/EP2021/073946 dated Jan. 10, 2022 with English translation.
(Continued)

*Primary Examiner* — Cheng Lin
(74) *Attorney, Agent, or Firm* — Collard & Roe, P.C.

(57) ABSTRACT

The invention relates to a track maintenance machine for tamping sleepers installed on a ballast bed of a track, comprising a machine frame movable on rail-based running gears, track lifting and lining units for correcting the track geometry as well as two 1-sleeper tamping units arranged one behind the other in the direction of the longitudinal axis of the machine that work independently of one another, with each tamping unit comprising at least four tamping unit segments that work independently of one another, adjustable in height via vertical drives and horizontally shiftable in the transverse direction of the machine via transverse drives, with each tamping unit segment comprising at least one tamping tool carrier, with opposing tamping tools being
(Continued)

Figure 1:
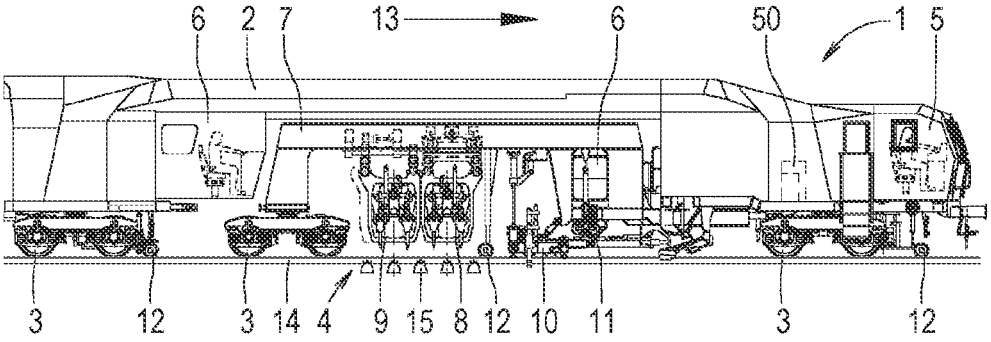

mounted on the tamping tool carrier and coupled via a vibration drive. It is provided that one of the two tamping units is designed as a turnout tamping unit, that by means of a shifting unit consisting of three transverse guiding units that work independently of one another the associated tamping unit segments are transversely shiftably mounted and can be positioned outwards with respect to the longitudinal axis of the machine in relation to the machine frame or in relation to a satellite frame movable along the longitudinal axis of the machine, and that the other tamping unit is designed as a plain-line tamping unit in such a way that the associated tamping unit segments are transversely shiftably mounted and can be positioned with only one shifting unit. This increases the machine's performance and thus its tamping output when maintaining plain lines and/or turnouts.

15 Claims, 5 Drawing Sheets

(52) U.S. Cl.
CPC ..... *E01B 2203/10* (2013.01); *E01B 2203/12* (2013.01); *E01B 2203/122* (2013.01)

(56) References Cited

U.S. PATENT DOCUMENTS

| | | | | | |
|---|---|---|---|---|---|
| 5,007,349 | A * | 4/1991 | Theurer | E01B 27/17 | 104/7.2 |
| 5,007,350 | A * | 4/1991 | Theurer | E01B 27/17 | 104/7.2 |
| 5,127,334 | A * | 7/1992 | Theurer | E01B 27/16 | 104/12 |
| 5,343,810 | A * | 9/1994 | Theurer | E01B 27/17 | 104/12 |
| 5,515,788 | A * | 5/1996 | Theurer | E01B 27/17 | 104/7.2 |
| 5,752,447 | A | 5/1998 | Theurer et al. | | |
| 5,862,759 | A * | 1/1999 | Mauli | E01B 27/20 | 104/12 |
| 7,383,777 | B2 * | 6/2008 | Theurer | E01B 27/16 | 104/12 |
| 10,106,934 | B2 * | 10/2018 | Hofer | E01B 29/00 | |
| 11,179,750 | B2 * | 11/2021 | Philipp | E01B 27/17 | |
| 2019/0032282 | A1 * | 1/2019 | Ganz | E01B 27/20 | |

FOREIGN PATENT DOCUMENTS

| | | | | | |
|---|---|---|---|---|---|
| DE | 1 534 080 | A1 | 11/1969 | | |
| DE | 15 34 080 | A | 11/1969 | | |
| DE | 4313300 | A1 * | 11/1993 | E01B 27/17 | |
| DE | 29622255 | U1 * | 2/1997 | | |
| EP | 0564433 | A1 * | 10/1993 | E01B 27/17 | |
| EP | 0 584 055 | A1 | 6/1996 | | |
| EP | 3271232 | A1 | 1/2018 | | |
| GB | 2 267 304 | A | 12/1993 | | |
| JP | S57-29701 | A | 2/1982 | | |
| JP | H09-195206 | A | 7/1997 | | |
| JP | H08-26404 | A | 9/1999 | | |
| WO | WO-2016054667 | A1 * | 4/2016 | E01B 27/17 | |

OTHER PUBLICATIONS

Austrian Search Report in Austrian Application No. A 50786/2020 dated Jun. 25, 2021.

Matisa, Hochleistungs-Universal-Stopfmaschinen, 2018-07-nn, https://www.matisa.ch/brochures_pdf/de/bourreuses_universelles_de.pdf, with English translation, 11 pages.

* cited by examiner

TRACK MAINTENANCE MACHINE FOR TAMPING A TRACK

CROSS REFERENCE TO RELATED APPLICATIONS

This application is the National Stage of PCT/EP2021/073946 filed on Aug. 31, 2021, which claims priority under 35 U.S.C. § 119 of Austrian Application No. A50786/2020, filed on Sep. 16, 2020, the disclosure of which is incorporated by reference. The international application under PCT article 21(2) was not published in English.

FIELD OF TECHNOLOGY

The invention relates to a track maintenance machine for tamping sleepers installed on a ballast bed of a track, comprising a machine frame movable on rail-based running gears, track lifting and lining units for correcting the track geometry as well as two 1-sleeper tamping units arranged one behind the other in the direction of the longitudinal axis of the machine that work independently of one another, with each tamping unit comprising at least four tamping unit segments that work independently of one another, adjustable in height via vertical drives and horizontally shiftable in the transverse direction of the machine via transverse drives, with each tamping unit segment comprising at least one tamping tool carrier, with opposing tamping tools being mounted on the tamping tool carrier and coupled via a vibration drive. The invention further relates to a method for operating the machine.

PRIOR ART

The traffic load on the track caused by rolling stock leads to settlements in the ballast bed. The resulting track geometry faults increase the forces acting on the vehicle-permanent way interaction. In order to increase the lifetime of a track, once its quality has deteriorated accordingly, the track must be corrected in its position and tamped. For this purpose, a variety of tamping units exists. This is due to the different application requirements. The distinction is mainly made between the work processes of track tamping and turnout tamping. The skilled person refers to track tamping when normal courses of track are tamped, while turnout tamping requires the best possible and most economical maintenance and tamping in the turnout area. In order to meet the demands for the tamping output, in addition to 1-sleeper tamping units in smaller machines, powerful multiple-sleeper tamping units are used in large machines. There is an ever-increasing demand for so-called universal tamping machines which, due to their universal equipment, are used both on open track as well as in the turnout area. These machines offer a high degree of flexibility for operators in the field. Turnouts pose a particular challenge due to numerous obstacles in the track area as well as continuous bearers below all four rails. In general, bearers are used in turnout construction in order to be able to transport the prefabricated units to the construction site quickly and ready for installation.

In the turnout, however, the so-called 4-rail tamping in combination with 3rd rail lifting is currently only applicable to a limited extent with regard to a required transverse projection of the tamping units as well as the loads acting on the machine as a result. As a rule, tamping machines intended for this purpose have to be reversed within the turnout in the opposite direction of work in order to be able to work through all four rails step by step. A track of the highest quality can only be achieved by simultaneously lifting and tamping the bearers in one pass.

Figure 7:
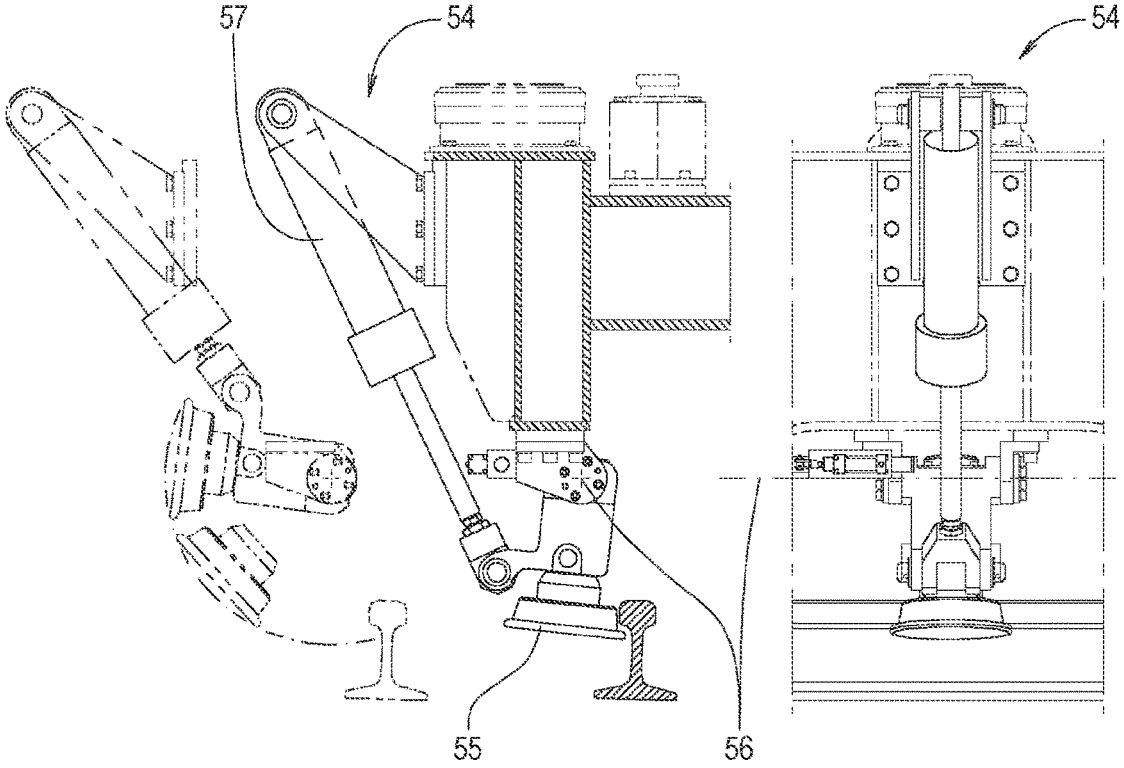

EP 0564433 A1 describes a tamping machine for tamping a track using a 2-sleeper tamping unit with tamping tools with tamping tines that can be squeezed by means of vibration drives for the simultaneous tamping of two adjacent sleepers. With reference to FIG. 7, the patent specification describes a further development of the tamping unit in which a slidable bearing enables a turnout to be maintained. In this, the tamping unit segments are shiftably mounted in relation to the machine frame on guiding units via an intermediate frame and additionally can be rotated via a vertical axis. Continuous turnout maintenance and thus the handling of bearers is not possible without reversing the machine due to the low, limited transverse shiftability of the tamping units. Furthermore, with this 2-sleeper tamping unit design, two rows of tamping tools each penetrate the same sleeper crib when lowering the tamping units into the ballast during the tamping process. The result is a high penetration resistance and enormous loads on man and machine. This causes significant wear on the tamping units as well as the ballast bed itself; the service life reduces significantly.

Presentation of the Invention

The object of the invention is to provide a track maintenance machine of the kind mentioned above with an improvement compared to prior art in such a way as to increase the machine's performance and thus the its tamping output when maintaining plain lines and/or turnouts, and additionally, to achieve an increased service life of the ballast as well as of the tamping tools. Furthermore, less stress on the operating staff as well as on the tamping units is to be achieved. In addition, a method of maintaining a track carried out by means of the improved machine is to be indicated.

According to the invention, these objects are achieved by way of a machine with the features of independent claim 1 and a method according to the features of independent claim 11, Dependent claims indicate advantageous embodiments of the invention.

It is provided that one of the two tamping units is designed as a turnout tamping unit, that by means of a shifting unit consisting of three transverse guiding units that work independently of one another the associated tamping unit segments are transversely shiftably mounted and can be positioned outwards with respect to the longitudinal axis of the machine in relation to the machine frame or in relation to a satellite frame movable along the longitudinal axis of the machine, and that the other tamping unit is designed as a plain-line tamping unit in such a way that the associated tamping unit segments are transversely shiftably mounted and can be positioned with only one shifting unit. This extended transverse shiftability of the tamping unit, which is designed over several guiding levels, enables tamping the entire course of the turnout for common courses of turnouts without having to reverse the machine in the opposite direction of work. In particular, this enables complete maintenance after lifting and lining the track from an actual track geometry to a target track geometry by means of the lifting and lining unit even in the case of bearers. The turnout tamping unit follows the course of the track of the two diverging rails by shifting transversely in relation to the longitudinal axis of the machine. The plain-line tamping unit can also be shifted transversely; in curved tracks, the tamping unit segments can be aligned according to the course of the track with a simple shift. Outside the turnout area, both tamping units are intended for use on open tracks in order to achieve the maximum tamping output.

One design provides that the tamping unit segments of the turnout tamping unit are transversely shiftable on first transverse guides of a first transverse guiding unit, that the first transverse guiding unit is transversely shiftable on second transverse guides of a second transverse guiding unit, and that the second transverse guiding unit is transversely shiftable on third transverse guides of a third transverse guiding unit in relation to the machine frame or the satellite frame. A massive, stable implementation on three guiding levels ensures a secure bearing of the tamping unit segments and thus the absorption of the enormous moments due to the forces caused by lowering and lifting the tamping tools into the ballast bed.

It is advantageous if the front tamping unit, as seen in the direction of work, is designed as a turnout tamping unit. This geometric arrangement offers the smallest distance within the turnout between the respective sleeper to be tamped and the lifting point of the 3rd rail lifting unit at the rail of the track diverging from the main rail. The 3rd rail lifting unit is usually arranged in front of the lifting and lining unit. This arrangement also offers the machine operator the best possible view of the work processes from the work cab and thus contributes significantly to a high level of operating comfort while reducing the likelihood of operating errors and thus possible damage to the track system.

It is particularly advantageous if both tamping units are arranged one behind the other in the direction of the longitudinal axis of the machine and if all tamping tools arranged one behind the other are approximately the same distance to each other in a neutral penetration position. The tamping axes of the two 1-sleeper tamping units are thus arranged in the direction of the longitudinal axis of the machine with approximately the double sleeper spacing. This causes only one row of tamping tools to be lowered into the sleeper cribs, i.e. the space between two sleepers filled with ballast. A row of tamping tools conceptually includes the tamping tools arranged next to each other on an imaginary axis in the transverse direction of the machine. Thus, each tamping unit has two rows of tamping tools, which, during the tamping process, are squeezed towards each other by means of vibration drives and cause the ballast below the sleeper to be compacted. In conventional tamping units, two rows of tamping tools penetrate a sleeper crib, whereas in this embodiment only one row of tamping tools per sleeper crib is lowered. This significantly reduces the penetration resistance for the tamping tools and, at the same time, the high loads and vibrations transmitted to the machine. A significant physical relief for the operating staff is also to be emphasised. In addition to less wear on the machine components, the ballast bed is also preserved. Moreover, the grinding effect occurring due to two rows of tamping tools in a sleeper crib is thus obsolete. Otherwise, ballast grains end up in the area between the rear tamping tine surfaces of two rows of tamping tools where they are ground by means of the vibrational movement acting on each other. This comminution results in an undesired reduction of the average ballast grain size with each tamping process. The preservation of the ballast now achieved is evidence of the longer service life of the entire track bed. In addition, with only one row of tamping tools per sleeper crib, there is an extended free space for the tamping tool movement and thus larger squeezing distances are possible. As a result, better compaction and thus higher quality of the track geometry is achieved.

It is advantageous if the second tamping unit, not designed as a turnout tamping unit, is shiftably mounted in the direction of the longitudinal axis of the machine by means of a longitudinal shifting unit. This allows a simple and quick adjustment to different sleeper spacing without changing the position of the tamping tools. The machine can be used in a particularly flexible way by the operator. In combination with the above-mentioned advantages of the tamping tools' tamping axes arranged one behind the other with double sleeper spacing, a comfortable maintenance of Y-sleepers is possible. Complex adaptations or conversions are not necessary. For tamping Y-sleepers, one rail is tamped with two tamping unit segments of the front tamping unit, and the other rail is tamped with the tamping unit positioned behind the front one.

In a further development, it is provided that mechanical devices serving as tipping prevention are attached on both outer track sides of the machine on at least one rail-based running gear each, with the devices being swivelable about an axis of rotation and having tilting rolling bodies engaging around a rail head. Due to large transverse shifting paths of the tamping units, the overall centre of gravity shifts from the centre axis of the machine outwards. The tipping prevention ensures safe operation in all working situations, even when the track is superelevated and inclined.

Also, one embodiment provides that a 3rd rail lifting unit is arranged on the machine frame, or alternatively on the opposing satellite frame which is movable in the direction of the longitudinal axis of the machine, and that the distance between the lifting point of the track lifting and lining unit and the tamping axis of the plain-line tamping unit is approximately the same as the distance between the lifting point of the 3rd rail lifting unit and the tamping axis of the turnout tamping unit.

An approximation of these two distances ensures approximately equal, elastic deflection behaviour of the track during the lifting and lining process in line with the classical beam theory.

It is also advantageous if the tamping tools of at least one tamping unit are swivelably mounted about an axis running approximately in the direction of the longitudinal axis of the machine and can be positioned by means of swivel drives. In case of obstacles on the superstructure, also as is the case with narrow, limited working conditions in the turnout area, the tamping tools can be adjusted to the respective situation by tilting. This means that individual tamping tools can be completely deactivated, but also that only parts of the relevant track area can be tamped.

One embodiment provides for the two tamping units to be assembled modularly as well as symmetrically with respect to the kinematic and geometric arrangement and/or bearing of the tamping tools in relation to their respective tamping axes. A tamping axis is the vertical centre axis of a sleeper to be tamped in the longitudinal section of the track. The result is smaller mass forces at reduced vibration and thus less loading on all components of the tamping units, especially the rolling and plain bearings. In addition to the increased service life, the modular, symmetrical design reduces the number of parts used and minimises the costs for stocking spare parts and procurement. Servicing work can thus be performed with less effort and in a shorter time. Furthermore, with reduced vibration a considerable increase in comfort at the operating staffs workplace is to be emphasised.

In a further embodiment of the invention, it is provided that the tamping tools of at least one tamping unit can be adjusted independently of one another in their inclination before lowering into the ballast bed by means of targeted actuation of the squeezing drives. This means that the tamping tools can be adjusted quickly and easily in the case of slanting sleepers in the turnout area. A complex and expensive turning unit for the tamping unit segments or the entire tamping unit is no longer necessary.

In the method according to the invention for operating the machine, the tamping unit segments of the turnout tamping unit and the tamping unit segments of the plain-line tamping unit are positioned in the transverse direction of the machine in a coordinated manner by means of associated transverse drives, wherein all transverse drives are actuated by means of shared control equipment. This ensures optimum adjustment and alignment of the tamping unit segments to the course of the track. Particularly in the turnout area, this ensures quick and user-friendly work.

In this context, it is advantageous that the tamping unit segments of the turnout tamping unit are transversely adjusted in relation to the first transverse guiding unit by means of associated transverse drives, that the second transverse guiding unit is transversely adjusted in relation to the third transverse guiding unit by means of an associated transverse drive, and that the third transverse guiding unit is transversely adjusted in relation to the machine frame or the satellite frame by means of an associated transverse drive. The transverse guiding units, which can be actuated independently of one another, offer flexible operating as well as setting modes in combination with the control equipment and, in addition to manual operation by the operating staff, are also intended for assisted, semi-automated, or fully automated operation.

One embodiment of the invention provides that in a so-called acyclic method of work, a tamping cycle is carried out with the following successive work steps:

- With a first lowering, squeezing, returning, and lifting of all tamping unit segments, two sleepers are tamped simultaneously;
- The tamping units are moved forward by one sleeper spacing;
- With a lowering, squeezing, returning, and lifting of all tamping unit segments, the next two sleepers are tamped;
- The tamping units are moved forward by triple the sleeper spacing; and that in the event of an obstacle in the track area, tamping unit segments positioned above the obstacle in each case are not lowered. In addition to the advantage of penetration of only one row of tamping tools per sleeper crib, these work steps offer particularly efficient operation of the tamping machine on open track.

In a further embodiment, in a so-called cyclic method of work, a tamping cycle is carried out in the turnout area with the following successive work steps:

- With a lowering, squeezing, returning, and lifting of all tamping unit segments, two sleepers are tamped simultaneously;
- The tamping units are moved forward by one sleeper spacing;
- With a lowering, squeezing, returning, and lifting of all tamping unit segments, the next two sleepers are tamped.

Furthermore, the tamping unit segments of the turnout tamping unit are positioned above two diverging track rails during forward movement in the direction of work with increasing, projecting displacement in the transverse direction of the machine by actuating the transverse drives assigned to the respective transverse guiding units by means of the shared control equipment, whereby in the event of an obstacle in the track area, tamping unit segments positioned above the obstacle in each case are not lowered. These work steps are characterised by an efficient maintenance of turnout areas in the direction of work.

An improvement of the method further provides that for tamping Y-sleepers the distance between tamping axes of the tamping units is adjusted to an existing actual dimension of the Y-sleepers and that, in the case of a cyclic method of work, a tamping cycle is carried out with the following successive work steps:

- Only two tamping unit segments with up to eight tamping tools are activated per tamping unit, which are combined into one tamping group per tamping unit, with one tamping group each being positioned to the left and right of the longitudinal axis of the machine;
- With a lowering, squeezing, returning, and lifting of both tamping groups with four activated tamping unit segments, one left section of a first Y-sleeper and one right section of a second Y-sleeper are each tamped simultaneously;
- The tamping units are moved forward by one step width of the Y-sleepers. Furthermore, in the event of an obstacle in the track area, tamping unit segments positioned above the obstacle in each case are not lowered. This further expands the machine's wide range of applications.

BRIEF DESCRIPTION OF THE DRAWINGS in the following, the invention is explained by way of example with reference to the accompanying figures. The following figures show in schematic illustrations:

FIG. 1 Side view of a track maintenance machine for maintaining a track

Figure 2:
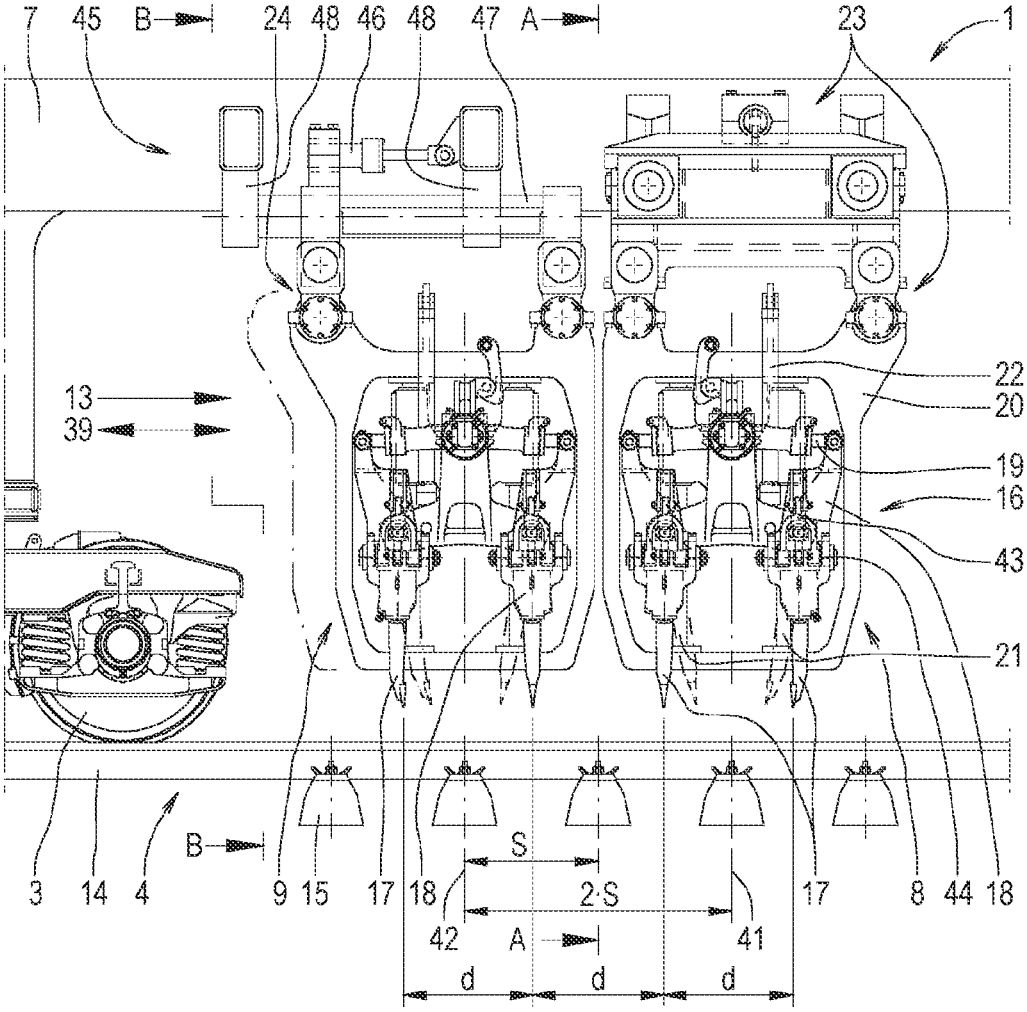
Figure 3:
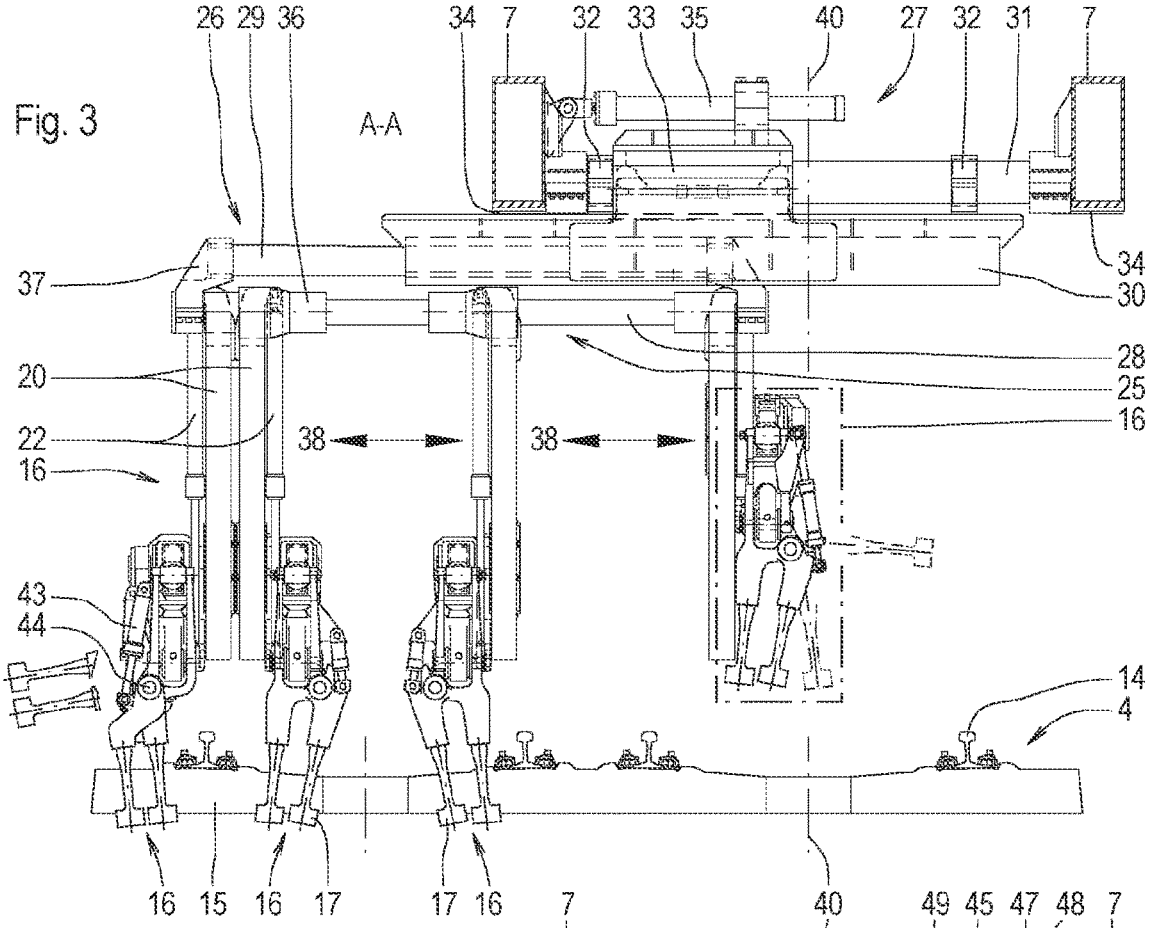
Figure 4:
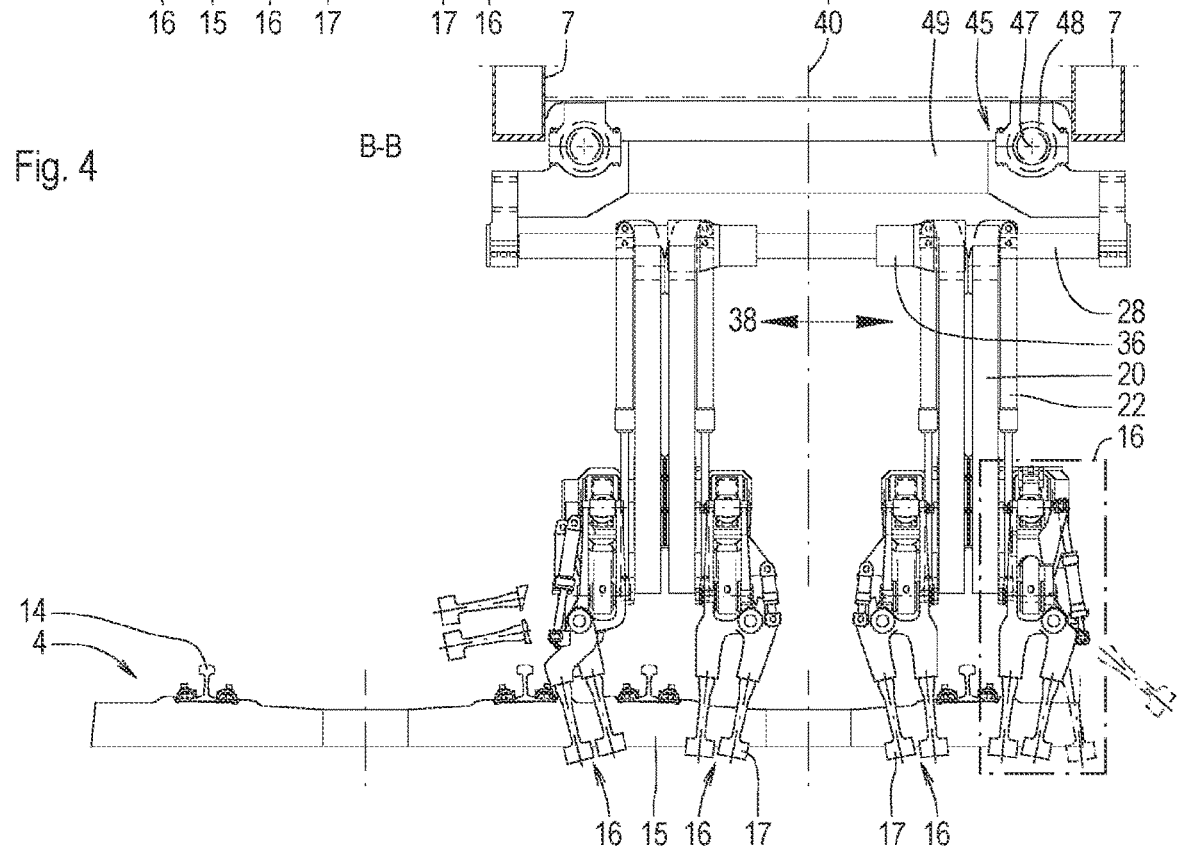
Figure 5:
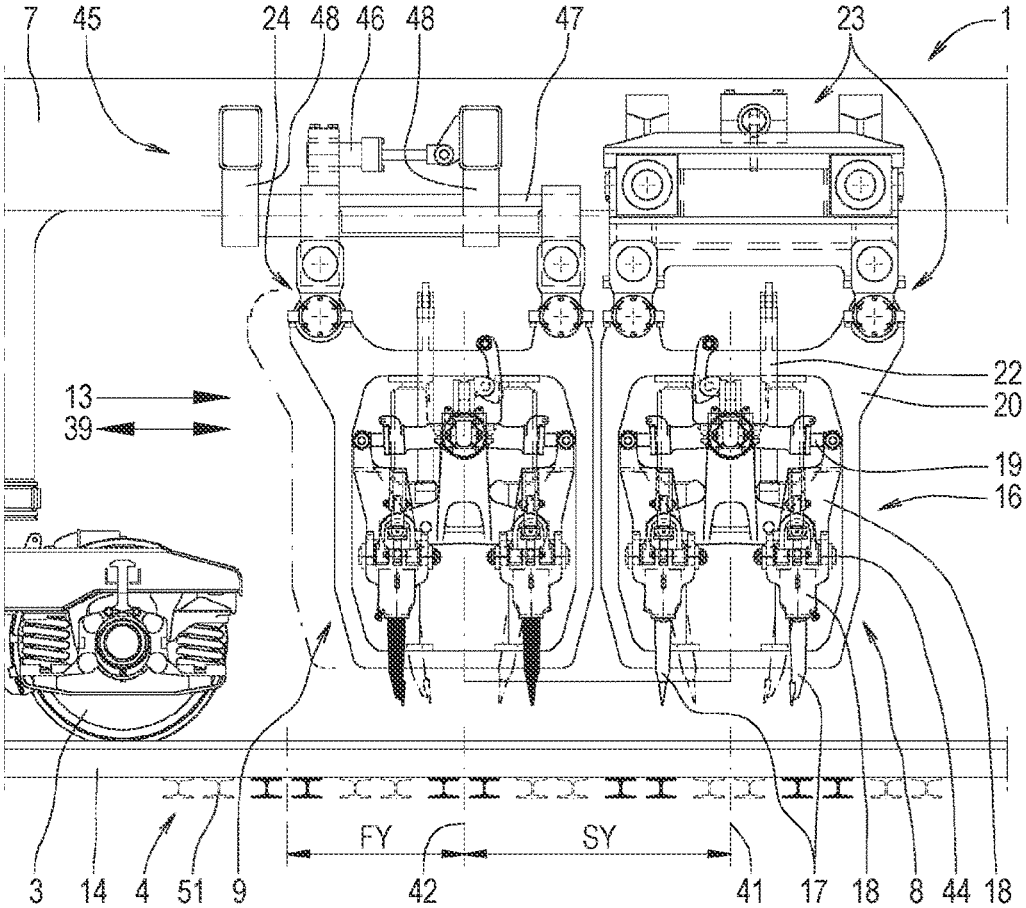
Figure 6:
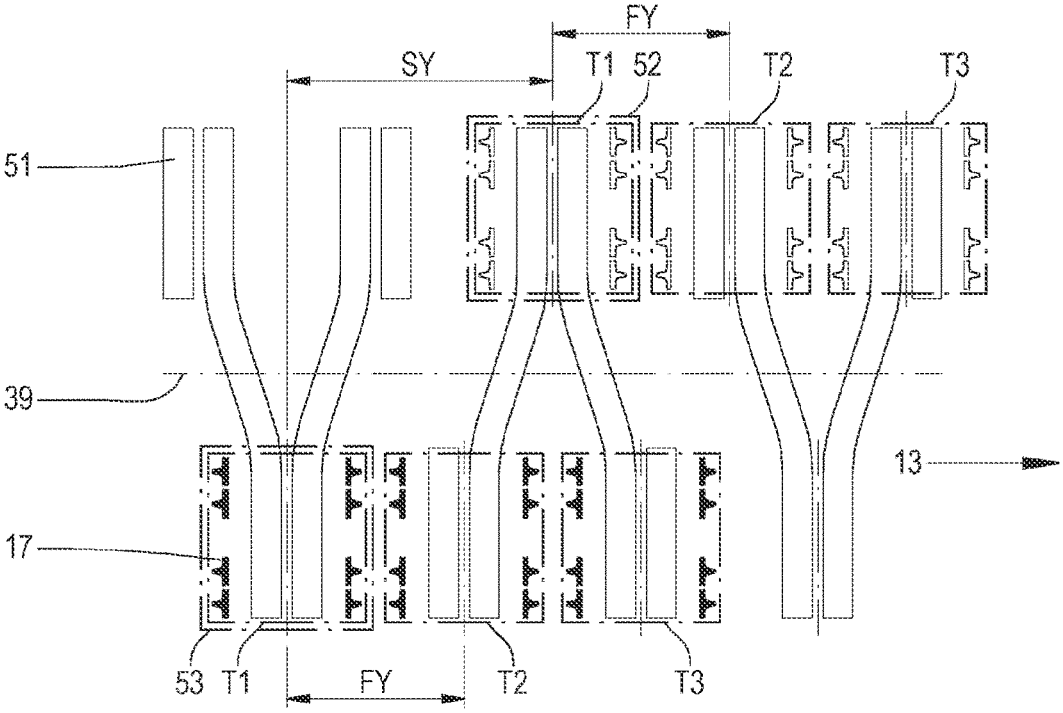
Figure 8:
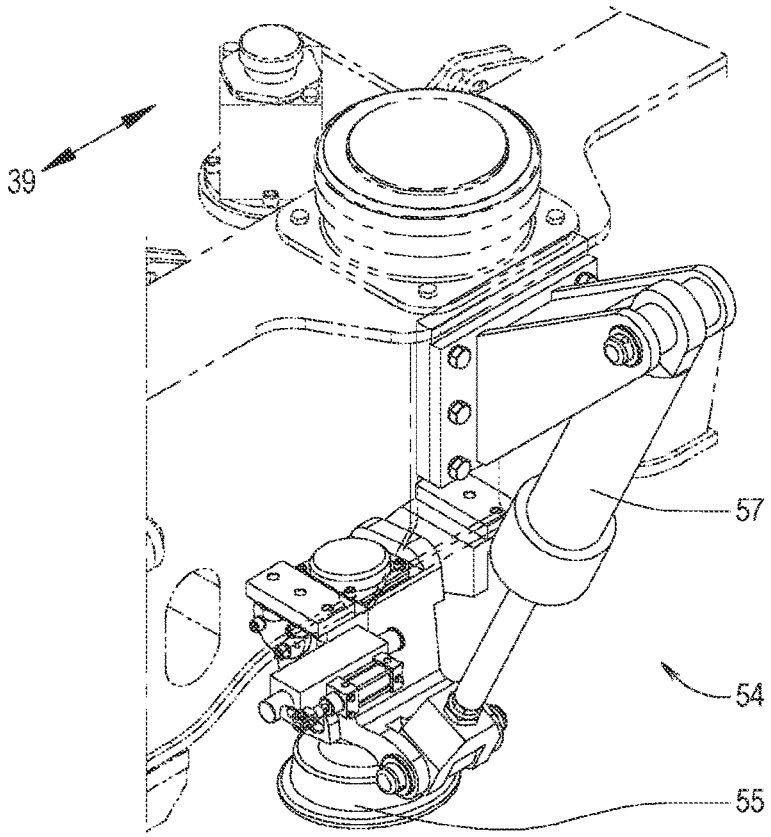
Figure 9:
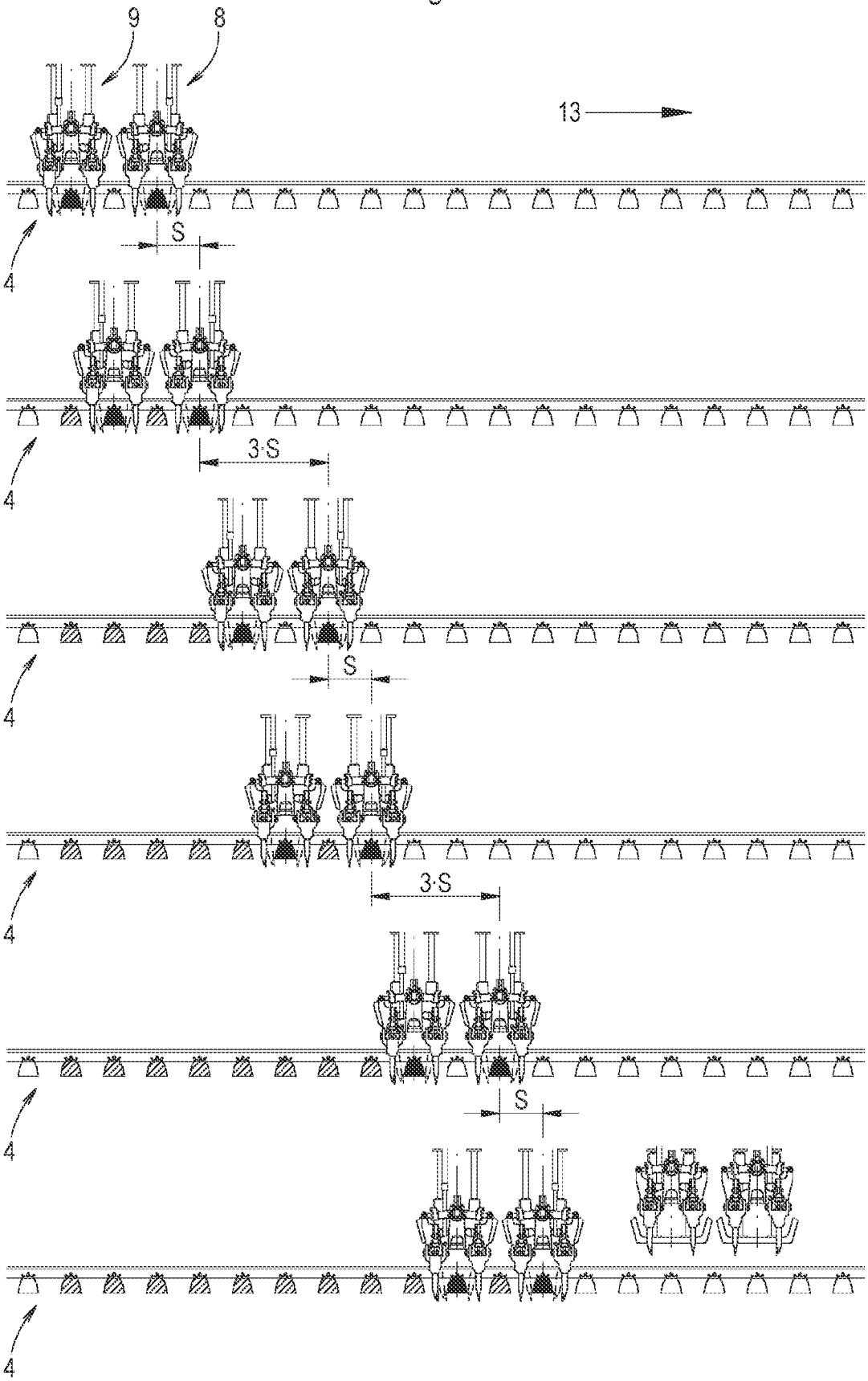

FIG. 2 Enlarged view from FIG. 1 showing a section of the tamping units of the track maintenance machine FIG. 3 Sectional view A-A from FIG. 2 during turnout maintenance FIG. 4 Sectional view B-B from FIG. 2 during turnout maintenance FIG. 5 Enlarged view with reference to FIG. 2 showing a section of the tamping units with Y-sleepers FIG. 6 Top view of the tamping pattern of the arrangement from FIG. 5 with Y-sleepers FIG. 7 Additional device tipping prevention, front and side view FIG. 8 Additional device tipping prevention, isometric drawing FIG. 9 Tamping diagram for methods with an acyclic method of work

DESCRIPTION OF THE EMBODIMENTS

FIG. 1 shows a track maintenance machine 1 designed for tamping sleepers 15 supported on a ballast bed of a track 4, Track 4 is generally understood to be the totality of rails 14, sleepers 15, superstructure, ballast, turnout parts, overhead contact line and signalling equipment. The machine 1 comprises a machine frame 2 supported and movable on ran-based running gears 3. A satellite frame 7 movable in the direction of the longitudinal axis of the machine 39 is mounted on the machine frame 2, on which two tamping units 8-9 are attached one behind the other. In a simpler embodiment variant of the machine 1 not shown, the satellite frame 7 is omitted in a discontinuous-action track tamping machine. The tamping units 8-9 are then attached to the machine frame 2.

The machine 1 further comprises a lifting and lining unit 10 for lifting and lining the track panel formed of rails 14 and sleepers 15. The current rail and/or track geometry is detected by means of a levelling and lining reference system 12, with one associated measuring device each being positioned directly in front of the tamping unit 8 at the very front as well as in the front and rear area of the machine 1, A 3rd rail lifting unit 11 is attached in close proximity to the lifting and lining unit 10 for maintaining turnouts. In the turnout, this manipulates a rail of a track 4 diverging from the main rail by means of an additional lifting point.

A rear cab 5 is arranged on the front side and a operator's cab 6 is located on both sides in the area adjacent to the tamping units 8-9. All work processes are controlled and/or monitored from the operator's cabs 6 by at least one operator with a clear view of the tamping units 8-9, the lifting and lining unit 10, and the 3rd rail lifting unit 11. A video system not shown is additionally arranged. It detects and monitors the track 4 as well as the position and location of the work units. Depending on the degree of automation, one or both operator's cabs 6 may be omitted. Control equipment 50 is attached on the machine frame 2 to control, regulate, and monitor all processes. It comprises computing units and a guiding computer.

FIG. 2 shows an enlarged view from FIG. 1 showing a section of the tamping units 8-9 of the machine 1. The front position on the satellite frame 7, as seen in the direction of work 13, is occupied by the turnout tamping unit 8 followed by the plain-line tamping unit 9. Both tamping units 8-9 are designed as 1-sleeper tamping units, so that one sleeper 15 can be worked per tamping cycle and per tamping unit.

Each of the two tamping units 8-9 is formed of four tamping unit segments 16 that can be used independently of one another and are arranged in the transverse direction of the machine 38. These are mounted on guide rods 21 in a height-adjustable manner by means of vertical drives 22 and can be shifted horizontally in the transverse direction of the machine 38 by means of transverse drives. For better clarity, these transverse drives are not shown. Each tamping unit segment 16 comprises tamping tool carriers 18 which are coupled via a vibration drive 19 (e.g. eccentric drive). Opposing tamping tools 17 are mounted on the tamping tool carrier 18; these are designed as so-called tamping tines.

Components of the vibration drive 19 are hydraulic linear actuators, which ensure that the tamping tool carriers 18 are squeezed towards each other. This squeezing, which is superimposed by the oscillation amplitude of the vibration drive 19, enables the compaction of the ballast below the sleeper 15. In an alternative variant not shown, a hydraulic cylinder is arranged between the tamping tool carrier 18 and the respective tamping tool 17, which is set up both as a vibration drive and a squeezing drive. A pulsating hydraulic pressure is applied to the hydraulic cylinder to generate vibration. During a squeezing process, the pulsating hydraulic pressure superimposes the squeezing pressure generated by means of the hydraulic cylinder. A tamping unit segment 16 is supported by sliding elements on two guide rods 21 each of a stable construction, a tamping unit frame 20.

The turnout tamping unit 8 is designed in such a way that the associated tamping unit segments 16 with their respective tamping unit frames 20 are shiftably mounted and can be positioned in the transverse direction of the machine 38 by means of a multi-level shifting unit 23. The tamping units 16 of the plain-line tamping unit 9, on the other hand, are shiftably mounted and can be positioned in the transverse direction of the machine 38 by means of a simple shifting unit 24. In addition, a longitudinal shifting unit 45 is set up to adjust the sleeper spacing 2·S in the direction of the longitudinal axis of the machine 39. The sleeper spacing 2·S is given by the distance between two tamping axes 41-42 of the respective tamping units 8-9. The arrangement is assembled in such a way that all the tamping tools 17 of both tamping units 8-9 arranged one behind the other are approximately the same distance d to each other in the direction of the longitudinal axis of the machine 39 in a neutral penetration position. The tamping tool carriers 18 are rotatably mounted via a swivelling axis 44 lying parallel to the longitudinal axis of the machine 39 and thus the tamping tools 17 can be tilted upwards. Actuation is carried out via swivel drives 43.

The longitudinal shifting unit 45 comprises a shifting drive 46 arranged parallel to the longitudinal axis of the machine 39, which is firmly connected to the satellite frame 7. A longitudinal carrier frame 49 (see FIG. 4) is shiftably mounted via two longitudinal guide rods 47 by means of sliding bearings 48 and is also connected to the shifting drive 46.

FIG. 3 shows a sectional view A-A from FIG. 2 with tamping unit segments 16 of the turnout tamping unit 8 extended to the left and crosswise to the vertical centre axis of the machine 40 in working position during turnout maintenance. The multi-level shifting unit 23 comprises three transverse guiding units 25, 26, 27 that work independently of one another and which are transversely shiftably mounted and can be positioned with respect to the centre axis of the machine 40 in relation to the satellite frame 7. The shifting drives of the lower, first transverse guiding unit 25 and the second transverse guiding unit 26 are not shown in FIG. 3. These are arranged parallel to transverse guides 28-29 on the respective plane. The upper, third transverse guiding unit 27 can be shifted in the transverse direction of the machine 38 by means of a shifting drive 35. On the one hand, the shifting drive 35 is firmly connected to the satellite frame 7 and, on the other hand, to the carrier frame 33 of the third transverse guiding unit 27, which is designed as a centre table. The tamping unit frames 20 of the tamping unit segments 16 are shiftably mounted on the transverse guides 28 of the first transverse guiding unit 25 via sliding bearings 36. In addition, the transverse guides 28 are attached to the transverse guides 29 of the central, second transverse guiding unit 26 by means of angle connectors 37. The transverse guides 29 are shiftably mounted in the guide frame 30 of the third transverse guiding unit 27.

The guide frame 30 and the carrier frame 33 are firmly connected together, with clamp-shaped supporting elements 32 being attached to the guide frame 30 and movable in the transverse direction of the machine 38. Both the guide frame 30 and the supporting elements 32 are slidably mounted on two transverse guide rods 31 in relation to the satellite frame 7. Furthermore, sliding plates 34 are arranged on the underside of the satellite frame 7. During operation, they transmit parts of the forces and/or moments emanating from the tamping unit segments 16 from the guide frame 30 to the structure of the satellite frame 7.

FIG. 4 shows a sectional view B-B from FIG. 2 with the plain-line tamping unit 9 in working position during turnout maintenance. The tamping unit segments 16 are assembled identically as in the previous embodiments. In this embodiment, the transverse guides 28 are attached firmly to a longitudinal carrier frame 49 of the longitudinal shifting unit 45. This longitudinal carrier frame 49 is slidably mounted on the longitudinal guide rods 47 by means of sliding bearings 48. The shifting drive 46 is not shown here.

Analogously to FIG. 2, FIG. 5 shows an enlarged view of the tamping units for tamping a track 4 with Y-sleepers 51. The tamping tools 17 of the plain-line tamping unit 9 are completely filled with colour in the illustration. The distance between the tamping axes 41-42 of the tamping units 8-9 is adjusted to an existing actual dimension SY of the Y-sleepers 51. For each tamping process, the tamping units 8-9 are advanced by one step width FY in a cyclical method of work.

FIG. 6 shows a top view of the tamping pattern of the arrangement in FIG. 5 with Y-sleepers 51 and is intended to clearly illustrate the tamping processes. A first tamping process is defined by the two tamping groups T1, each lying to the left and right of the longitudinal axis of the machine 39. Only two of the four tamping unit segments 16 are activated and lowered per tamping unit 8-9. The left tamping group T1 is worked by the turnout tamping unit 8, while the right tamping group T1 is worked by the plain-line tamping unit 9 (analogously to FIG. 5, completely filled with colour in the illustration). In order to load all four tamping unit segments 16 of the respective tamping units 8-9 evenly during operation, the responsibility for maintaining the left and right sides can be exchanged diagonally. Then, the left tamping group T1 is worked by the plain-line tamping unit 9, while the right tamping group T1 is worked by the turnout tamping unit 8. The other tamping groups T2-T3 illustrate subsequent tamping processes as an example.

An additional tipping prevention device is shown in FIG. 7 in front and side view. The device 54 comprises a rolling body 55 swivelably mounted via an axis of rotation 56 by means of a swivel drive 57. The rolling body 55 engages around a rail head of the track 4. The side view shown in dashed lines on the far left illustrates the device 54 in deactivated, upper swivel position. In addition to FIG. 7, FIG. 8 shows an isometric drawing of the additional tipping prevention device.

FIG. 9 shows a tamping diagram for a method of maintaining a track using an acyclic method of work. The two tamping units 8-9 are arranged one behind the other with the distance 2·S. This distance 2·S of the tamping axes 41-42 to each other corresponds to the illustration in FIG. 2 with double sleeper spacing S. After each tamping process, both tamping units 8-9 are moved forward alternately by the sleeper spacing S (forward path=S) and by triple the sleeper spacing 3·S (forward path=3·S) in the direction of work 13. This way, all sleepers are tamped most efficiently with two 1-sleeper tamping units.

The invention claimed is:

1. A track maintenance machine for tamping sleepers installed on a ballast bed of a track, comprising;

a machine frame movable on rail-based running gears wherein the machine frame has a longitudinal axis, a plurality of track lifting and lining units for correcting the track geometry;

at least two 1-sleeper tamping units arranged one behind the other in the direction of the longitudinal axis of the machine that work independently of one another, with each tamping unit comprising at least four tamping unit segments that work independently of one another, a plurality of vertical drives;

a plurality of transverse drives, wherein said plurality of vertical drives are configured to make said 1-sleeper tamping units adjustable in height via at least one of said plurality of vertical drives and horizontally shiftable in a transverse direction of the machine via said plurality of transverse drives, with each tamping unit segment comprising at least one tamping tool carrier, with opposing tamping tools being mounted on the tamping tool carrier and coupled via a vibration drive, wherein one of the two tamping units is designed as a turnout tamping unit, that by means of a shifting unit consisting of three transverse guiding units that work independently of one another the associated tamping unit segments are transversely shiftably mounted and can be positioned outwards with respect to the longitudinal axis of the machine in relation to the machine frame or in relation to a satellite frame movable along the longitudinal axis of the machine, and that the other tamping unit is designed as a plain-line tamping unit in such a way that the associated tamping unit segments are transversely shiftably mounted and can be positioned with only one shifting unit;

wherein the tamping unit segments of the turnout tamping unit are transversely shiftable on first transverse guides of a first transverse guiding unit, that the first transverse guiding unit is transversely shiftable on second transverse guides of a second transverse guiding unit, and that the second transverse guiding unit is transversely shiftable on third transverse guides of a third transverse guiding unit in relation to the machine frame or the satellite frame.

2. The machine according to claim 1, wherein the front tamping unit, as seen in the direction of work, is designed as a turnout tamping unit.

3. The machine according to claim 1, wherein both tamping units are arranged one behind the other in the direction of the longitudinal axis of the machine and that all tamping tools arranged one behind the other are approximately the same distance (d) to each other in a neutral penetration position.

4. The machine according to claim 1, wherein the second tamping unit, not designed as a turnout tamping unit, is shiftably mounted in the direction of the longitudinal axis of the machine by means of a longitudinal shifting unit.

5. The machine according to claim 1, wherein mechanical devices serving as tipping prevention are attached on both outer track sides of the machine on at least one rail-based running gear each, with the devices being swivelable about an axis of rotation and having tilting rolling bodies engaging around a rail head.

6. The machine according to claim 1, wherein a 3rd rail lifting unit is arranged on the machine frame, or alternatively on the opposing satellite frame which is movable in the direction of the longitudinal axis of the machine, and that the distance between the lifting point of the track lifting and lining unit and the tamping axis of the plain-line tamping unit is approximately the same as the distance between the lifting point of the 3rd rail lifting unit and the tamping axis of the turnout tamping unit.

7. The machine according to claim 1, wherein the tamping tools of at least one tamping unit are swivelably mounted about an axis running approximately in the direction of the longitudinal axis of the machine and can be positioned by means of swivel drives.

8. The machine according to claim 1, wherein the two tamping units are assembled modularly as well as symmetrically with respect to the kinematic and geometric arrangement and/or bearing of the tamping tools in relation to their respective tamping axes.

9. The machine according to claim 1, wherein the tamping tools of at least one tamping unit can be adjusted independently of one another in their inclination before lowering into the ballast bed by means of targeted actuation of the squeezing drives.

10. A method for tamping a track with a machine according to claim 1, wherein the tamping unit segments of the turnout tamping unit and the tamping unit segments of the plain-line tamping unit are positioned in the transverse direction of the machine in a coordinated manner by means of associated transverse drives, wherein all transverse drives are actuated by means of shared control equipment.

11. The method according to claim 10, wherein the tamping unit segments of the turnout tamping unit are transversely adjusted in relation to the first transverse guiding unit by means of associated transverse drives, that the second transverse guiding unit is transversely adjusted in relation to the third transverse guiding unit by means of an associated transverse drive, and that the third transverse guiding unit is transversely adjusted in relation to the machine frame or the satellite frame by means of an associated transverse drive.

12. The method according to claim 10, wherein in a so-called acyclic method of work, a tamping cycle is carried out with the following successive work steps:

With a first lowering, squeezing, returning, and lifting of all tamping unit segments, two sleepers are tamped simultaneously;

The tamping units are moved forward by one sleeper spacing;

With a lowering, squeezing, returning, and lifting of all tamping unit segments, the next two sleepers are tamped;

The tamping units are moved forward by triple the sleeper spacing;

and that in the event of an obstacle in the track area, tamping unit segments positioned above the obstacle in each case are not lowered.

13. The method according to claim 10, wherein in a so-called cyclic method of work, a tamping cycle is carried out with the following successive work steps:

With a lowering, squeezing, returning, and lifting of all tamping unit segments, two sleepers are tamped simultaneously;

The tamping units are moved forward by one sleeper spacing;

With a lowering, squeezing, returning, and lifting of all tamping unit segments, the next two sleepers are tamped;

and that the tamping unit segments of the turnout tamping unit are positioned above two diverging track rails during forward movement in the direction of work with increasing, projecting displacement in the transverse direction of the machine by actuating the transverse drives assigned to the respective transverse guiding units by means of the shared control equipment, whereby in the event of an obstacle in the track area, tamping unit segments positioned above the obstacle in each case are not lowered.

14. The method according to claim 10, wherein for tamping Y-sleepers the distance between tamping axes of the tamping units is adjusted to an existing actual dimension of the Y-sleepers and that, in the case of a cyclic method of work, a tamping cycle is carried out with the following successive work steps:

Only two tamping unit segments with up to eight tamping tools are activated per tamping unit, which are combined into one tamping group per tamping unit, with one tamping group each being positioned to the left and right of the longitudinal axis of the machine;

With a lowering, squeezing, returning, and lifting of both tamping groups with four activated tamping unit segments, one left section of a first Y-sleeper and one right section of a second Y-sleeper are each tamped simultaneously;

The tamping units are moved forward by one step width of the Y-sleepers;

and that in the event of an obstacle in the track area, tamping unit segments positioned above the obstacle in each case are not lowered.

15. A track maintenance machine for tamping sleepers installed on a ballast bed of a track, comprising:

a machine frame movable on rail-based running gears wherein the machine frame has a longitudinal axis, a plurality of track lifting and lining units for correcting the track geometry;

at least two 1-sleeper tamping units arranged one behind the other in the direction of the longitudinal axis of the machine that work independently of one another, with each tamping unit comprising at least four tamping unit segments that work independently of one another, a plurality of vertical drives;

a plurality of transverse drives, wherein said plurality of vertical drives are configured to make said 1-sleeper tamping units adjustable in height via at least one of said plurality of vertical drives and horizontally shiftable in a transverse direction of the machine via said plurality of transverse drives, with each tamping unit segment comprising at least one tamping tool carrier, with opposing tamping tools being mounted on the tamping tool carrier and coupled via a vibration drive, wherein one of the two tamping units is designed as a turnout tamping unit, that by means of a shifting unit consisting of three transverse guiding units that work independently of one another the associated tamping unit segments are transversely shiftably mounted and can be positioned outwards with respect to the longitudinal axis of the machine in relation to the machine frame or in relation to a satellite frame movable along the longitudinal axis of the machine, and that the other tamping unit is designed as a plain-line tamping unit in such a way that the associated tamping unit segments are transversely shiftably mounted and can be positioned with only one shifting unit;

wherein mechanical devices serving as tipping prevention are attached on both outer track sides of the machine on at least one rail-based running gear each, with the devices being swivelable about an axis of rotation and having tilting rolling bodies engaging around a rail head.

* * * * *